US011507003B2

(12) United States Patent
Kinukawa et al.

(10) Patent No.: US 11,507,003 B2
(45) Date of Patent: Nov. 22, 2022

(54) FIXING UNIT THAT APPLIES A VOLTAGE TO SUBSTRATE OR A PRESSING MEMBER, AND IMAGE FORMING APPARATUS

(71) Applicant: Canon Kabushiki Kaisha, Tokyo (JP)

(72) Inventors: Tatsuya Kinukawa, Kanagawa (JP); Sho Taguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/174,514

(22) Filed: Feb. 12, 2021

(65) Prior Publication Data

US 2021/0263455 A1 Aug. 26, 2021

(30) Foreign Application Priority Data

Feb. 20, 2020 (JP) ..... JP2020-026803

(51) Int. Cl.
*G03G 15/20* (2006.01)
*G03G 15/00* (2006.01)

(52) U.S. Cl.
CPC ..... *G03G 15/2053* (2013.01); *G03G 15/2064* (2013.01); *G03G 15/80* (2013.01)

(58) Field of Classification Search
USPC ..... 399/88
See application file for complete search history.

(56) References Cited

U.S. PATENT DOCUMENTS 5,724,637 A * 3/1998 Senba ..... G03G 15/2064 399/324
6,993,279 B2 * 1/2006 Fukuzawa ..... G03G 15/2053 399/329
2003/0035667 A1 * 2/2003 Izawa ..... G03G 15/2053 399/333
2015/0153691 A1 * 6/2015 Ono ..... G03G 15/2053 399/33

(Continued)

FOREIGN PATENT DOCUMENTS

JP 06202509 A 7/1994
JP 2002049259 A 2/2002

(Continued)

OTHER PUBLICATIONS

Computer translation of JP2002-049269A to Masehide. (Year: 2002).*

*Primary Examiner* — Quana Grainger
(74) *Attorney, Agent, or Firm* — Venable LLP

(57) ABSTRACT

A fixing unit includes a film with a tubular shape, a nip forming unit including a heater and configured to be in sliding contact with an inner surface of the film. The heater includes a substrate made of metal. The fixing unit further includes a power supply connector electrically connected to the power supply electrode so that the power supply connector is connected to the heating element at a first end portion of the substrate in a longitudinal direction of the heater, and a pressing member opposed to the nip forming unit. The fixing unit further includes a voltage application circuit configured to apply a voltage of a same polarity as a (Continued)

normal charging polarity of the toner to the substrate, the voltage application circuit being connected to the substrate at a second end portion of the substrate opposite to the first end portion in the longitudinal direction.

10 Claims, 9 Drawing Sheets

(56) References Cited

U.S. PATENT DOCUMENTS

| | | | | |
|---|---|---|---|---|
| 2016/0223959 | A1* | 8/2016 | Uekawa | G03G 15/2017 |
| 2018/0203390 | A1* | 7/2018 | Honke | G03G 15/2028 |
| 2018/0307177 | A1* | 10/2018 | Karino | G03G 15/80 |

FOREIGN PATENT DOCUMENTS

| | | | | | |
|---|---|---|---|---|---|
| JP | 2002189376 | A | | 7/2002 | |
| JP | 2008268629 | A | | 11/2008 | |
| JP | 2012198516 | A | * | 10/2012 | B32B 1/08 |

* cited by examiner

FIXING UNIT THAT APPLIES A VOLTAGE TO SUBSTRATE OR A PRESSING MEMBER, AND IMAGE FORMING APPARATUS

BACKGROUND OF THE INVENTION

Field of the Invention

The present disclosure relates to a fixing unit for fixing an image on a recording material, and an image forming apparatus for forming an image on a recording material.

Description of the Related Art

An example of a fixing unit that adopts a heat-fixing system installed in a printer or a copying machine of an electrophotographic system is equipped with a heater having a heating resistor provided on a substrate formed of ceramics or the like, a fixing film that moves while being in contact with the heater, and a pressure roller arranged to oppose to the heater with the fixing film interposed therebetween. The recording material that bears an unfixed toner image is heated while being nipped and conveyed by a nip portion, i.e., fixing nip portion, formed between the fixing film and the pressure roller, by which the toner image borne on the recording material is heated and fixed to the recording material.

In the above-described fixing unit, especially when a recording material that is dry and has a high electric resistance is passed through, there may occur a case where a surface of a pressure roller is charged-up by friction between the recording material and the pressure roller, causing image defects called "electrostatic offset" in which unfixed images on the recording material are peeled away. Japanese Patent Application Laid-Open Publication No. H06-202509 discloses a technique in which a conducting plane being exposed at a portion of a fixing film and a conductive elastic member provided on a core metal of a pressure roller are in contact with one another at a fixing nip portion to realize conduction, while having the fixing film and the pressure roller grounded to prevent charge-up.

However, in recent years, the speed of print output by the image forming apparatus has advanced, and the amount of charge-up of the pressure roller caused by the friction between the recording material and the pressure roller tends to be increased. However, an attempt to reduce electrostatic offset by providing a conductive layer to the fixing film and applying a bias voltage for cancelling out charge-up of the pressure roller may result in electrical breakdown of a part of a surface layer of the fixing film.

SUMMARY OF THE INVENTION

The present disclosure provides a fixing unit and an image forming apparatus that can reduce occurrence of electrostatic offset which reducing electrical breakdown.

According to one aspect of the invention, a fixing unit includes a film with a tubular shape, a nip forming unit including a heater and configured to be in sliding contact with an inner surface of the film. The heater includes a substrate made of metal, an insulating layer formed on the substrate, a heating element arranged on the insulating layer and configured to generate heat when electric current flows therethrough, and a power supply electrode electrically connected to the heating element. The fixing unit further includes a power supply connector electrically connected to the power supply electrode so that the power supply connector is connected to the heating element at a first end portion of the substrate in a longitudinal direction of the heater, a pressing member opposed to the nip forming unit with the film interposed therebetween and configured to form a nip portion with the film A recording material is nipped and conveyed at the nip portion while an image formed by toner on the recording material is heated and fixed to the recording material. The fixing unit further includes a voltage application circuit configured to apply a voltage of a same polarity as a normal charging polarity of the toner to the substrate, the voltage application circuit being connected to the substrate at a second end portion of the substrate opposite to the first end portion in the longitudinal direction.

According to another aspect of the invention, a fixing unit includes a film with a tubular shape, a nip forming unit including a heater and configured to be in sliding contact with an inner surface of the film. The heater includes a substrate made of metal, an insulating layer formed on the substrate, and a heating element arranged on the insulating layer and configured to generate heat when electric current flows therethrough. The substrate is electrically grounded. The fixing unit further includes a pressing member opposed to the nip forming unit with the film interposed therebetween and configured to form a nip portion with the film, wherein a recording material is nipped and conveyed at the nip portion while an image formed by toner on the recording material is heated and fixed to the recording material, and a voltage application circuit configured to apply a voltage of an opposite polarity as a normal charging polarity of the toner to the pressing member.

Further features of the present invention will become apparent from the following description of exemplary embodiments with reference to the attached drawings.

DESCRIPTION OF THE EMBODIMENTS

Exemplary embodiments according to the present disclosure will be described with reference to the drawings.

First Embodiment (1) Image Forming Apparatus

Figure 1:
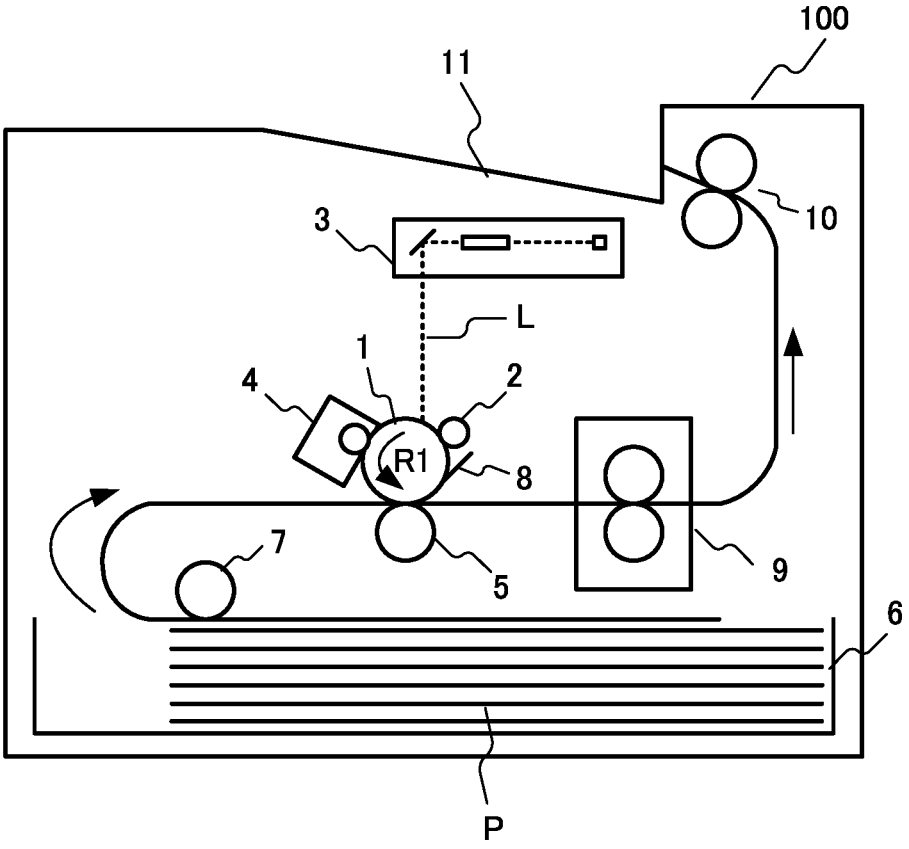
FIG. 1 is a schematic diagram illustrating an image forming apparatus according to a first embodiment.

FIG. 1 is a cross-sectional view of a laser beam printer, hereinafter simply referred to as printer 100, that adopts an electrophotographic technology and that serves as an image forming apparatus according to a first embodiment. Now, a configuration and operation of the printer 100 will be described briefly.

When a print command is received by the printer 100, a scanner unit 3 emits laser light L according to image information to a photosensitive member 1 serving as an image bearing member. The photosensitive member 1 charged to predetermined polarity by a charge roller 2 is scanned by laser light L, and an electrostatic latent image according to image information is thereby formed on a surface of the photosensitive member 1. Thereafter, toner is supplied to the photosensitive member 1 from a developing unit 4, and a toner image corresponding to the image information is formed on the photosensitive member 1. The toner image having reached a transfer portion, i.e., transfer nip portion, that has been formed between the photosensitive member 1 and a transfer roller 5 serving as a transfer unit along with the rotation of the photosensitive member 1 in the direction of arrow R1 is transferred onto a recording material P fed from a cassette 6 by a pickup roller 7. The surface of the photosensitive member 1 having passed the transfer nip portion is cleaned by a cleaner 8. The recording material P to which toner image t (FIG. 2) has been transferred is subjected to a fixing process by being heated and pressed in a fixing unit 9 of the heat-fixing system.

Thereafter, the recording material P is discharged onto a tray 11 by a sheet discharge roller 10. Various types of sheets of different sizes and materials may be used as the recording material P, such as paper including normal paper and thick paper, plastic films, cloth, coated paper and other sheet materials subjected to surface treatment, and sheets of special shapes such as envelopes and index paper. The present example is illustrated based on a system where toner image is directly transferred from the photosensitive member 1 to the recording material P, but it is also possible to apply the technique illustrated hereafter to an image forming apparatus that adopts a system where toner image formed on the photosensitive member is transferred to the recording material via an intermediate transfer member such as an intermediate transfer belt.

(2) Fixing Unit

The fixing unit 9 will now be described. The fixing unit 9 is a tensionless-type film heating system. That is, the fixing unit 9 uses a fixing film in the form of an endless belt, or a round tubular shape, having flexibility as a heat resistant film, and adopts a configuration where at least a part of the circumference of the fixing film is constantly tensionless and the fixing film rotates by rotational driving force of the pressing member.

Figure 2:
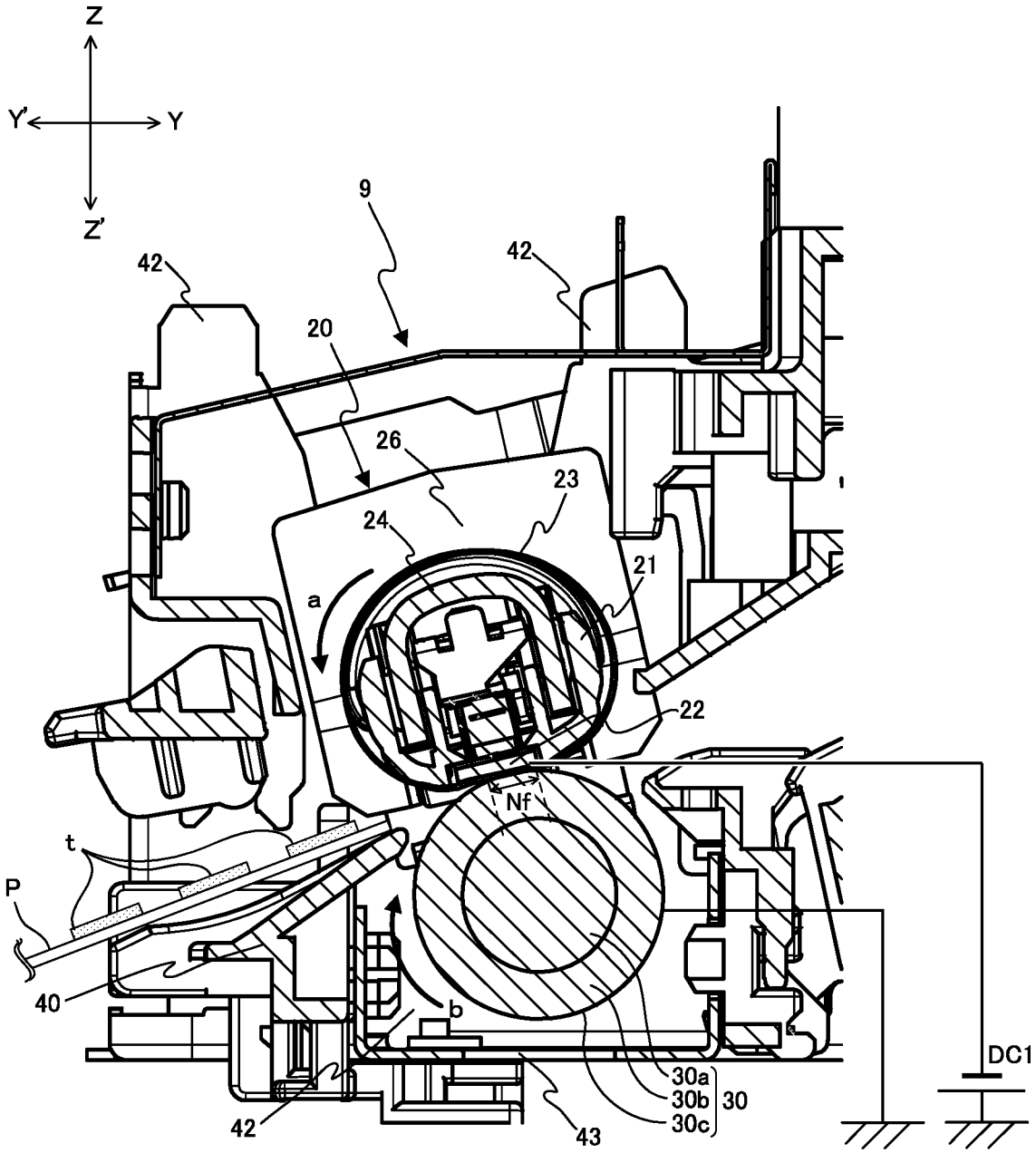
FIG. 2 is a cross-sectional view of a fixing unit according to the first embodiment.
Figure 3:
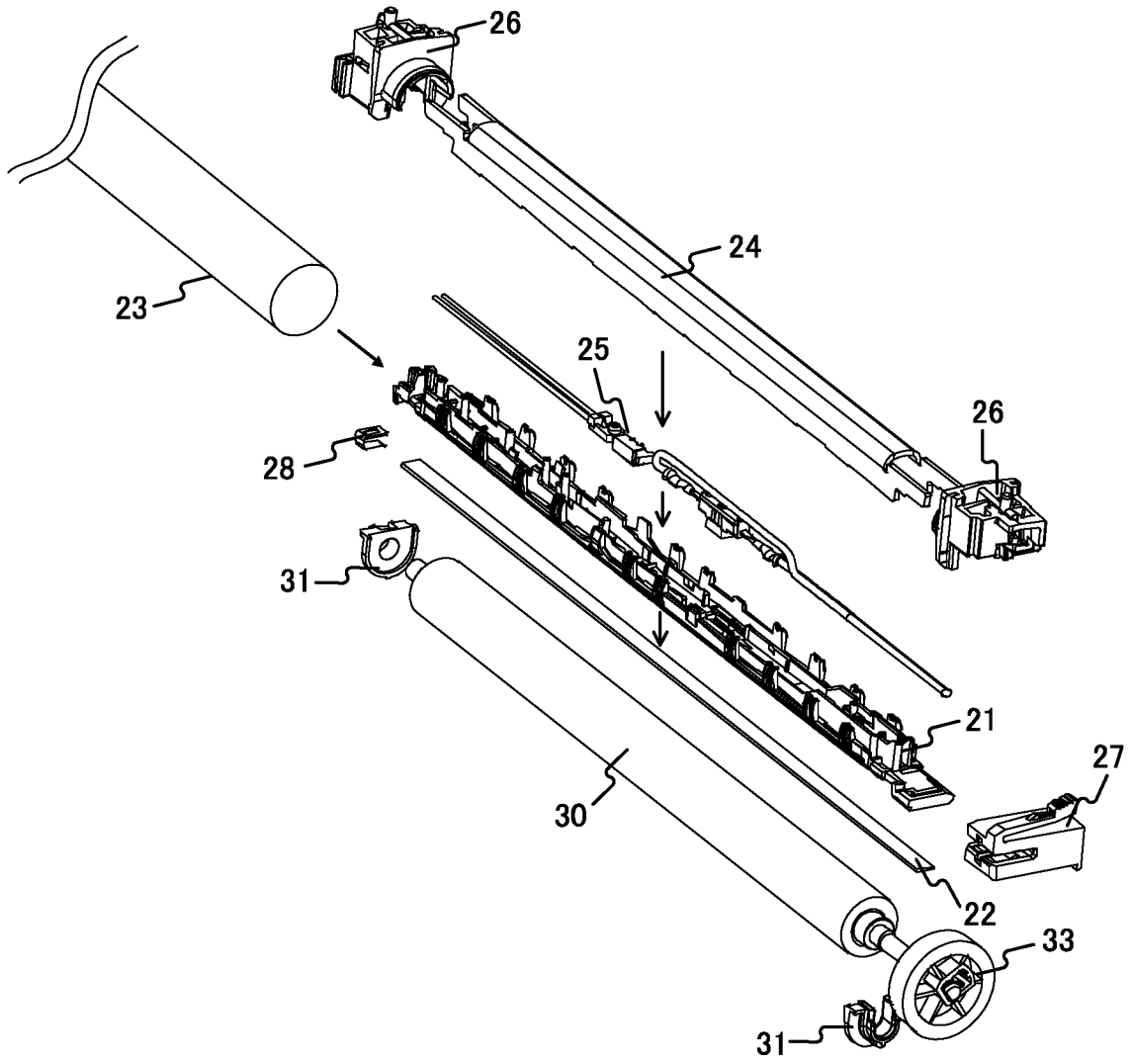
FIG. 3 is an exploded view of a film assembly used in the fixing unit according to the first embodiment.
Figure 4:
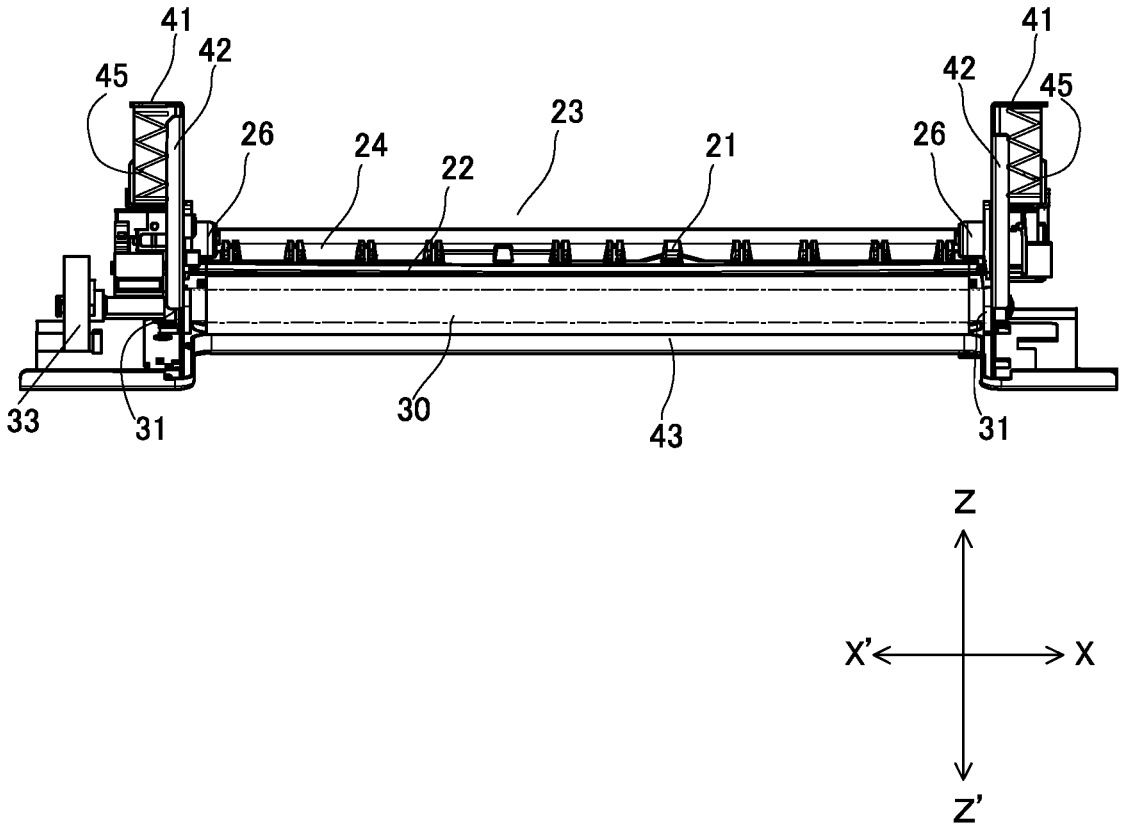
FIG. 4 is a front view illustrating a portion of the fixing unit according to the first embodiment.

Hereafter, the fixing unit 9 of the film heating system according to the present embodiment will be described in detail. FIG. 2 is a cross-sectional view of the fixing unit 9. FIG. 3 is an exploded perspective view of a film assembly 20 used in the fixing unit 9. FIG. 4 is a front view illustrating a portion of the fixing unit 9. In FIGS. 2 and 4, arrow X denotes a longitudinal direction of the fixing unit 9, arrow Z denotes upward in a vertical direction, and arrow Y denotes a direction perpendicular to the longitudinal direction and the vertical direction. Further, arrows X', Y' and Z' denote directions opposite to the respective arrows X, Y and Z.

The fixing unit 9 according to the present embodiment includes, as illustrated in FIGS. 2 to 4, a fixing film 23 having a tubular shape, a heater 22 serving as a heating member and disposed inside the fixing film 23 to be in contact with an inner surface of the fixing film 23, and a pressure roller 30 serving as a pressing member that is pressed toward the heater 22 via the fixing film 23. A fixing nip portion Nf serving as a nip portion between the fixing film 23 and the pressure roller 30 is formed at a portion overlapped with an area where the heater 22 is in contact with the fixing film 23. The heater 22 is held by a heater holder 21 which serves as a holding member formed of heat-resistant resin. The heater 22 and the heater holder 21 function as a nip forming unit of the present embodiment for forming the fixing nip portion Nf. The heater holder 21 also functions as a guide for guiding rotation of the fixing film 23. The pressure roller 30 receives driving force from a motor and rotates in the direction of arrow b. The fixing film 23 is driven by following the rotation of the pressure roller 30 and rotates in the direction of arrow a.

The heater holder 21 is a molded component formed of heat-resistant resin such as PPS (polyphenylene sulfide) or liquid crystal polymer. The heater 22 includes a substrate mainly composed of a pure metal or an alloy and having an elongated plate shape, i.e., metal substrate, a resistance heating element, i.e., heating element, that generates heat by electric power conduction, an insulating layer for insulating the resistance heating element and the substrate, and a glass coat layer for protecting the heating element. The details of the heater 22 will be described later.

A thermistor 25 serving as a temperature detecting element is abutted against the heater 22 at an opposite side, that is, upper side in the drawing, from an abutting surface against the fixing film 23. By controlling the electric power conduction to the heating element in accordance with the detection temperature of the thermistor 25, the temperature of the fixing nip portion Nf is maintained at a set temperature suitable for fixing the image.

The thickness of the fixing film 23 is preferably between 20 μm and 100 μm to ensure good thermal conductivity. A single-layer film formed of a material such as PTFE (polytetrafluoroethylene), PFA (tetrafluoroethylene—perfluoro alkyl vinyl ether copolymer) or PPS is suitable as the fixing film 23. Further, a composite layer film in which a surface of a base layer formed of a material such as PI (polyimide), PAI (polyamide imide), PEEK (polyether ether ketone) or PES (polyethersulfone) is coated with a material such as PTFE, PFA or FEP (tetrafluoroethylene—hexafluoropropylene copolymer) as a release layer, i.e., surface layer, is also suitable as the fixing film 23. Even further, it is also suitable to use a pure metal or an alloy having high thermal conductivity as the base layer, and to apply the aforementioned coating treatment and coating of a fluororesin tube to the release layer. The pure metal may be Al, Ni, Cu or Zn, and the alloy may be a stainless steel or an alloy of Al, Ni, Cu and/or Zn.

According to the present embodiment, PI having a thickness of 60 μm was used as the base layer of the fixing film 23, and coating of PFA having a thickness of 12 μm was provided as the release layer, considering both wear of the release layer by passing of sheets and thermal conductivity.

The pressure roller 30 serving as a pressing member, i.e., pressurizing rotary member, includes a core metal 30*a* formed of a material such as iron or aluminum, an elastic layer 30*b* formed of a material such as silicone rubber, and a release layer 30*c* formed of a material such as PFA (FIG. 2). The elastic layer 30*b* is formed on an outer circumference of the core metal 30*a*, and the release layer 30*c* is formed on an outer circumference of the elastic layer 30*b*, constituting an outermost layer of the pressure roller 30. A driving gear 33 (FIG. 3) is attached to one end portion in the axial direction of the core metal 30*a* of the pressure roller 30, and the pressure roller 30 rotates by receiving rotational driving force from a drive unit not shown via the driving gear 33.

The configuration of the fixing unit will now be described with reference to the cross-sectional view of FIG. 2. A reinforcement member 24 is formed of a metal such as iron, the member being provided to maintain strength so that the heater holder 21 will not deform greatly even when pressure is applied toward the pressure roller 30. The heater 22 is pressed toward the pressure roller 30 via the heater holder 21 and the reinforcement member 24 by a pressurizing member described later. An area where the pressure roller 30 and the fixing film 23 are in close contact with each other, i.e., pressure contact area, by the pressing force is referred to as the fixing nip portion Nf according to the present embodiment. A pressurizing position of the pressure roller 30, i.e., position of application point of pressing force of the heater 22 to the pressure roller 30, roughly corresponds to a position of a center portion of the heater 22 in a conveyance direction of the recording material.

Next, the present embodiment is described by referring to the perspective view of FIG. 3. The heater holder 21 has a gutter-like shape, i.e., U shape, in transverse section, and the reinforcement member 24 fits to an inner side of the gutter shape. A heater accommodating groove is provided on the heater holder 21 at a side opposed to the pressure roller 30, and the heater 22 is positioned at a desired position by fitting into the heater accommodating groove. The fixing film 23 is externally fit with circumferential margin to an outer side of the heater holder 21 to which the above-mentioned component has been assembled. An axial direction of the tubular shape of the fixing film 23, i.e., a direction of the arrow in which the fixing film 23 is inserted in the drawing, is the longitudinal direction (arrow X in FIGS. 2 and 4) of the fixing unit 9, which is also a longitudinal direction of the heater 22. In the present embodiment, the pressure roller 30, the heater 22 and the heater holder 21 are all long and narrow members that extend in the longitudinal direction of the heater 22.

Both end portions of the reinforcement member 24 in the longitudinal direction of the heater 22 are projected portions that protrude from both ends of the fixing film 23, having flange members 26 and 26 respectively fit thereto. The fixing film 23, the heater 22, the heater holder 21, the reinforcement member 24 and the flange members 26 and 26 are assembled together as the film assembly 20.

A power feed terminal of the heater 22 is also protruded from one side (i.e., first end portion) in the longitudinal direction of the heater 22 with respect to the fixing film 23, and a power supply connector 27 is fit to the power feed terminal. The power supply connector 27 is in contact with an electrode portion of the heater 22 with a certain contact pressure and constitutes a power supply path for supplying power fed from a commercial power supply to the heater 22.

A heater clip 28 is attached to the other side (i.e., second end portion opposite to the first end portion, that is, the side opposite to the power feed terminal) of the heater 22 in the longitudinal direction of the heater 22. The heater clip 28 is a metal plate that is bent in a U shape and has a spring property that enables the end portion of the heater 22 to be held on the heater holder 21.

Next, the present embodiment is described with reference to the front view of FIG. 4. The respective flange members 26 and 26 regulate movement in the longitudinal direction of the heater 22 of the fixing film 23 being driven to rotate, and thereby regulate the position of the fixing film 23 during operation of the fixing unit. A distance between flanges of the flange members 26 and 26, that is, parts coming into sliding contact with end portions of the fixing film, on both ends in the longitudinal direction of the heater 22 is set longer than the length of the fixing film 23 in the longitudinal direction of the heater 22. This arrangement enables to prevent the end portions of the fixing film from being damaged during normal state of use.

Further, the length of the pressure roller 30 in the longitudinal direction of the heater 22 is set approximately 10 mm shorter than the fixing film 23. This arrangement is adopted to prevent grease from leaking from ends of the fixing film 23 and adhering to the pressure roller 30, causing the pressure roller 30 to lose its gripping force on the recording material and slip.

The film assembly 20 is arranged to oppose to the pressure roller 30 and supported on a top-side casing 41 of the fixing unit 9 in a state where movement in the longitudinal direction of the heater 22, i.e., right-left directions in the drawing, is restricted and movement in the vertical direction is enabled. A pressurizing spring 45 serving as a pressurizing member is attached in a compressed manner to the top-side casing 41. The pressing force of the pressurizing spring 45 is received by the projected portion of the reinforcement member 24, and by having the reinforcement member 24 press against the pressure roller 30, the whole film assembly 20 is pressed against the pressure roller 30.

A bearing member 31 is provided to bear the core metal of the pressure roller 30 (refer also to FIG. 3). The bearing member 31 receives pressing force from the film assembly 20 via the pressure roller 30. In order to rotatably support the core metal of the pressure roller 30 that is heated to a relatively high temperature, the material of the bearing preferably has sufficient heat resistance and superior sliding property. The bearing member 31 is attached to a bottom-side casing 43 of the fixing unit.

The bottom-side casing 43 and the top-side casing 41 constitute a casing, i.e., frame member, of the fixing unit 9 together with frame side panels 42 and 42 that are provided on both sides of the film assembly 20 in the longitudinal direction of the heater 22 and extend upward and downward.

(3) Heater

Next, materials constituting the heater 22 according to the present embodiment and a method for manufacturing the same will be described with reference to FIGS. 5 to 7.

Figure 5:
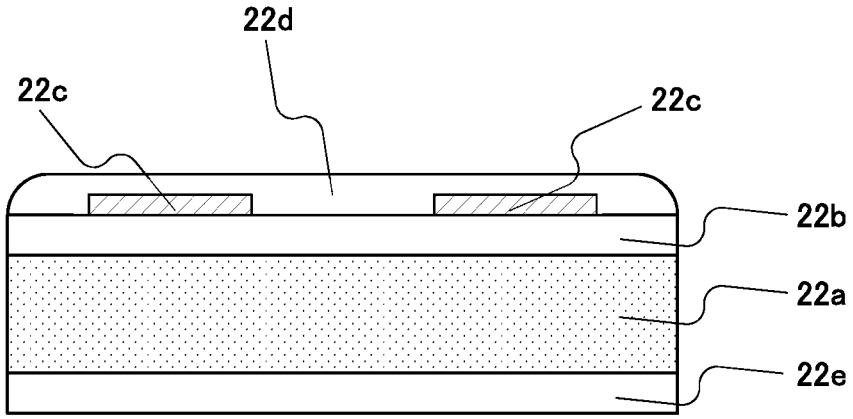
FIG. 5 is a cross-sectional view of a heater according to the first embodiment.

FIG. 5 is a cross-sectional view of the heater 22. The heater 22 includes a substrate 22*a* formed of metal, a heating element 22*c* serving as a heating resistance layer that generates heat when electric current flows therethrough, an insulating layer 22*b* that insulates the heating element 22*c* and the substrate 22*a*, and a cover layer 22*d* such as a glass coating layer that protects the heating element. The substrate 22*a* is an elongated plate shape member formed mainly of a pure metal or an alloy. In order to reduce warping of the substrate 22*a* during fabrication, an insulating layer 22*e*, that is, a second insulating layer when the insulating layer 22*b* is referred to as a first insulating layer, is also provided on a surface, i.e., second surface, that is opposite to a surface, i.e., first surface, to which the heating element 22*c* is provided in a thickness direction of the substrate 22*a*.

Materials such as stainless steel, nickel, copper and aluminum or an alloy mainly composed of these metals are suitably used as the material for the substrate 22*a*. Among these materials, stainless steel is most preferable from the viewpoint of strength, heat resistance and corrosion. The type of stainless steel is not specifically limited, and any type can be selected as required considering necessary mechanical strength, linear expansion coefficient corresponding to the shape of the insulating layer and the heating element described in the next section, availability of the plate material in the market, and so on.

As an example, a martensitic- or ferritic-type chromium-containing stainless steel has a relatively low linear expansion coefficient among stainless steels and is suitable since it can be easily applied to forming an insulating layer and a heating element.

The thickness of the substrate 22*a* is determined considering strength, heat capacity and radiation performance. A thin substrate 22*a* is advantageous for realizing a quick-start performance, that is, shortness of time from starting of electric power conduction to reaching a target temperature of the heater 22, since it has a small heat capacity, but if it is too thin, a problem such as distortion of the heating resistor during sintering (firing) treatment tends to occur. In contrast, a thick substrate 22*a* is advantageous from the viewpoint of preventing distortion of the heating resistor during sintering treatment, but excessive thickness increases the heat capacity and is disadvantageous in realizing a quick start. Preferable thickness of the substrate 22*a*, considering the balance of mass productivity, cost and performance, is between 0.3 mm and 2.0 mm.

The material of the insulating layers 22*b* and 22*e* is not specifically limited, but it is necessary to select an insulating material having heat resistance in view of the actual temperature during use. The material of the insulating layers 22*b* and 22*e* is preferably glass or PI (polyimide) from the viewpoint of heat resistance, and in the case of glass, the actual powder material to be used is selected within a range not deteriorating the characteristics of the present embodiment. A heat-conductive filler having an insulating property may be mixed as needed. There is no problem in using the same material or different materials for the insulating layers 22*b* and 22*e*. Similarly, the thickness may be the same within the insulating layers 22*b* and 22*e* or varied as needed.

In general, the heater 22 to be used in the image forming apparatus preferably has a dielectric voltage of approximately 1.5 kV. Therefore, the thickness of the insulating layer 22*b* is determined according to the material to realize a dielectric voltage performance of 1.5 kV between the heating element 22*c* and the substrate 22*a*.

The method for forming the insulating layers 22*b* and 22*e* is not specifically limited, but as an example, the insulating layers 22*b* and 22*e* can be formed smoothly by adopting screen printing. When forming an insulating layer of glass or PI (polyimide) on the substrate 22*a*, it is necessary to adjust the linear expansion coefficients of the substrate and the insulating layer material as required so that cracking and peeling do not occur in the insulating layer by the difference between linear expansion coefficients of the materials.

The heating element 22*c* is formed by printing a heating resistor paste having mixed (A) conductive component, (B) glass component and (C) organic binder component onto the insulating layer 22*b*, and then sintering the same. When the heating resistor paste is sintered, the (C) organic binder component is burnt out and only components (A) and (B) are left, so that the heating element 22*c* containing the conductive component and the glass component is formed.

In the embodiment, materials such as silver-palladium (Ag—Pd) and ruthenium oxide ($RuO_2$) are used alone or in combination as the conductive component (A), and a sheet resistance of 0.1 [Ω/□] to 100 [KΩ/□] is preferable. Materials other than those mentioned above in (A) to (C) can also be contained as long as the amount is subtle enough so as not to deteriorate the characteristics of the present embodiment.

Figure 6:
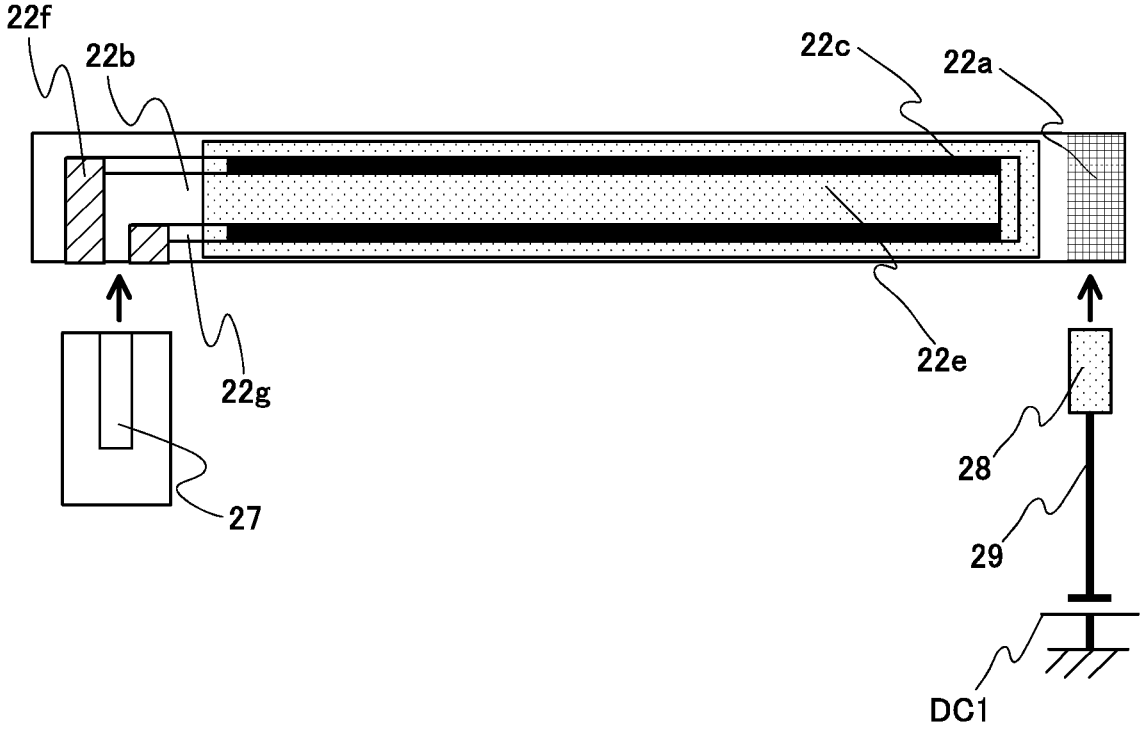
FIG. 6 is a schematic view illustrating a configuration for attaching a heater according to the first embodiment.
Figure 7:
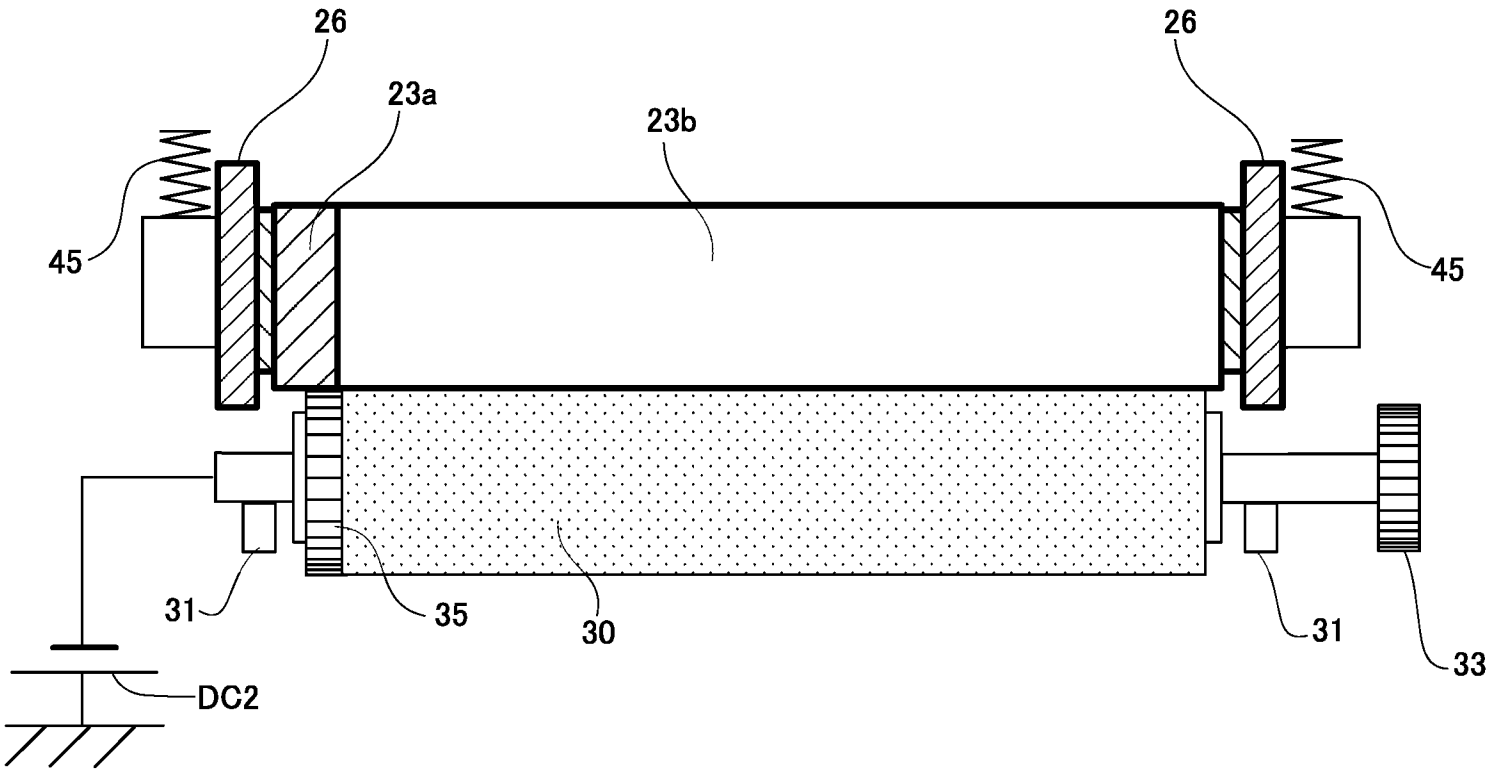
FIG. 7 is a front view of a fixing unit according to a comparative example.

A power supply electrode 22*f* and a conductive pattern 22*g* illustrated in FIG. 6 are mainly composed of a conductive component such as silver (Ag), platinum (Pt), gold (Au), silver-platinum (Ag—Pt) alloy or silver-palladium (Ag—Pd) alloy. The power supply electrode 22*f* and the conductive pattern 22*g* are formed, similar to the heat resistor paste, by printing a paste having mixed (A) conductive component, (B) glass component and (C) organic binder component to the insulating layer 22*b*, and then sintering the same. The power supply electrode 22*f* and the conductive pattern 22*g* are conductive parts that are provided to feed power to the heating element 22*c*, and the resistance is set sufficiently low compared to the heating element 22*c*.

Note that, it is desirable to select a material that softens and melts at a temperature lower than a melting point of the substrate 22*a* and a material that has sufficient heat resistance in consideration of the temperature during actual use as the aforementioned heating resistor paste and the paste for forming the power supply electrode and conductive pattern.

As illustrated in FIG. 5, the cover layer 22*d* that covers the heating element 22*c* and the conductive pattern 22*g* are provided on the insulating layer 22*b* of the heater 22. In a case where the heating element 22*c* is arranged at a side of the substrate 22*a* that contacts the fixing film 23, that is, lower side of FIG. 2, the cover layer 22*d* exerts a protective function of ensuring an electrical insulating property between the heating element 22*c* and the fixing film 23 and ensuring a sliding property between the heating element 22*c* and the fixing film 23. The material of the cover layer 22*d* is preferably glass or PI (polyimide) from the viewpoint of heat resistance, and a heat-conductive filler having an insulating property may be mixed thereto as needed.

In the present embodiment, a ferritic stainless-steel substrate (18 Cr stainless-steel) having a width of 10 mm, a length of 300 mm and a thickness of 0.5 mm was prepared as the substrate 22*a*.

Next, the glass paste for forming the insulating layer was applied on the aforementioned stainless-steel substrate by screen printing, and then dried at 180° C. and sintered at 850° C. to form the insulating layers 22*b* and 22*e*. The thickness of the insulating layers 22*b* and 22*e* after sintering was each 60 μm on both sides of the stainless-steel substrate.

Thereafter, a heating resistor paste and a paste for forming a power supply electrode and a conductive pattern were prepared. The heating resistor paste contains silver-palladium (Ag—Pd) as the conductive component, with a glass component and an organic binder component mixed thereto. The paste for forming the power supply electrode and the conductive pattern contains silver as the conductive component, with a glass component and an organic binder component mixed thereto. The respective pastes were applied to the stainless-steel substrate by screen printing, and then dried at 180° C. and sintered at 850° C. to form the heating element 22*c*, the power supply electrode 22*f* and the conductive pattern 22*g*. After sintering, the thickness of the heating element 22*c* was 15 μm, the length was 220 mm and the width was 1.1 mm.

Next, the glass paste for the cover layer was prepared, and the glass paste for the cover layer was applied on the heating element 22*c* and the conductive pattern 22*g* by screen printing, and then dried at 180° C. and sintered at 850° C. to form the cover layer 22*d*. The thickness of the cover layer 22*d* after sintering was 60 μm.

(4) Conductive Path of Thermal Fixing Unit

As illustrated in FIG. 6, according to the present embodiment, the heater clip 28 serving as a fastening member for fastening the heater 22 to the heater holder 21 also serves as a voltage application member, i.e., potential application member, that applies voltage to the substrate 22*a*. Since the heater clip 28 serving as a fastening member also serves as a component of the voltage application circuit, voltage application, i.e., potential application, to the substrate 22*a* is enabled by a relatively simple configuration. A bundle wire 29 extends from the heater clip 28, and the bundle wire 29 is connected to a power supply DC1 provided on a high-voltage circuit board installed in the printer 100.

The power supply DC1 applies a voltage of a same polarity as a normal charging polarity, which according to the present embodiment is negative polarity, of toner used for forming images through the bundle wire 29 and the heater clip 28 to the substrate 22*a*. In other words, the power supply DC1, the bundle wire 29 and the heater clip 28 constitute a voltage application circuit that applies voltage to the substrate 22*a*. A value of the voltage applied to the substrate 22*a* is adjusted as required to reduce electrostatic offset considering surface potential of the pressure roller 30 during fixing operation.

Moreover, a resistance value of the release layer 30*c* of the pressure roller 30 is adjusted to form an electric field between the substrate 22*a* and the pressure roller 30. A range of preferable resistance value is, for example, $1.0\times10^{8}$ [Ω/□] to $1.0\times10^{13}$ [Ω/□] (sheet resistance (surface resistance) when a voltage of 500 V is applied: measured using ADVANTEST R8340A, a product of Advantest Corp.). As illustrated in FIG. 2, the release layer 30*c* of the pressure roller 30 is grounded by a conductive path not shown.

(5) Effects

According to the present embodiment, by applying voltage to the substrate 22*a*, an electric field having a desired strength is formed in the fixing nip portion Nf and electrostatic offset is thereby reduced, without supplying current between the fixing film 23 and the pressure roller 30.

The effects of the present embodiment will be described through comparison with a comparative example. At first, a configuration where voltage is applied to a base layer 23*a* of the fixing film 23 as illustrated in FIG. 7 is described as a comparative example. A portion of the fixing film 23 is configured to have the base layer 23*a* locally exposed, and a conductive elastic member 35 provided on the core metal 30*a* of the pressure roller 30 is caused to be in contact with the base layer 23*a* of the fixing film 23 at the fixing nip portion. The core metal 30*a* (FIG. 2) is connected to a power supply DC2 and configured to apply voltage to the base layer 23*a* of the fixing film 23 through the core metal 30*a* and the conductive elastic member 35. Similar to the configuration of the embodiment, a resistance of the release layer 30*c* of the pressure roller 30 is adjusted to fall within the range of $1.0\times10^{8}$ [Ω/□] to $1.0\times10^{13}$ [Ω/□] (surface resistance when a voltage of 500 V is applied: measured using ADVANTEST R8340A).

In order to verify the effects of the present embodiment, the voltage applied to the substrate 22*a* was varied, and the occurrence of electrostatic offset and the occurrence of electrical breakdown of a release layer 23*b* of the fixing film 23 were confirmed. The confirmation was performed with the voltage applied to the substrate 22*a* ranging between −100V and −1000 V.

The electrostatic offset was tested under a low temperature and low humidity (temperature: 15° C., humidity: 10%) environment. A Xerox Vitality Multipurpose Paper (Xerox Corp., letter size, 75 g/m$^2$ grammage: hereinafter referred to as "Xerox paper") and a Neenah Bond Writing Paper (Neenah Inc., letter size, 60 g/m$^2$ grammage, cotton content of 25%: hereinafter referred to as "Neenah paper"), both having been left for two days under the above-mentioned low temperature and low humidity environment, were used. Neenah paper had higher paper surface resistance than Xerox paper, and the condition of Neenah paper is disadvantageous from the viewpoint of electrostatic offset. A halftone image with isolated dots of 600 dpi in which electrostatic offset is likely to occur are printed in the area of 5 mm to 20 mm from a leading edge of the sheet was printed as an evaluation image. Evaluation was performed by continuously printing images to 100 sheets and confirming whether soiling by offset toner has occurred to a solid white paper surface on a trailing side of 20 mm or farther from the leading edge of the paper.

Figure 8:
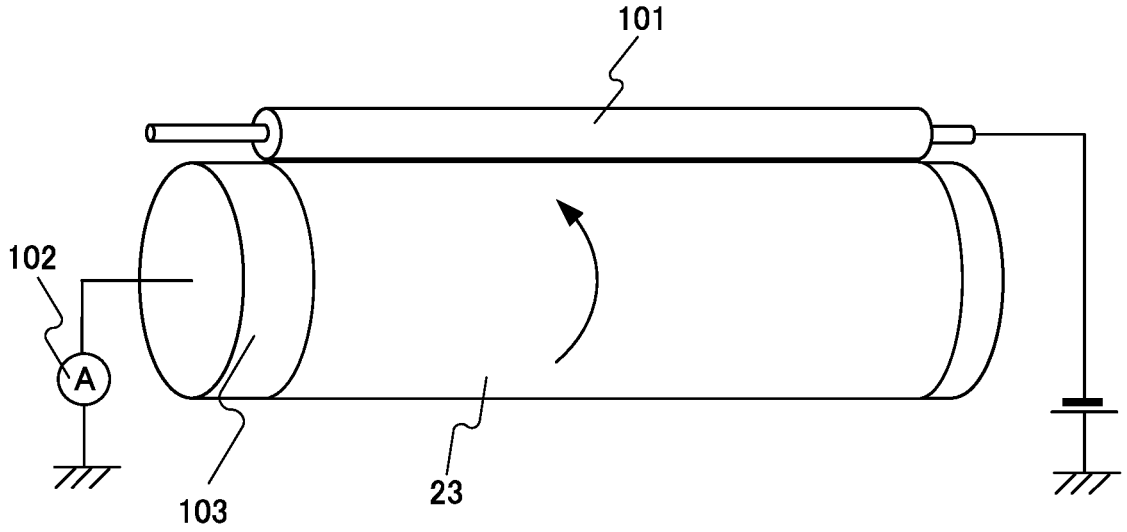
FIG. 8 is a view illustrating a method for performing a comparative test.

Electrical breakdown of the release layer of the fixing film 23 was confirmed by the following method. As illustrated in FIG. 8, the fixing film 23 was inserted to a cylindrical metal rod 103 having approximately the same outer diameter as the fixing film 23 and grounded, and the fixing film 23 is driven to rotate by following the rotation of the cylindrical metal rod 103. A rubber roller 101 having conductivity and driven to rotate by the fixing film 23 was caused to be in contact with an entire longitudinal area of the release layer 23*b*, and current flowing from the rubber roller to the metal rod by applying voltage in the range of −100 V to −1000 V to the rubber roller 101 was detected by an ammeter 102. Voltage was applied in a state where the fixing film 23 was rotated for a distance at least corresponding to a circumference length of the fixing film 23, and it was determined that there was no electrical breakdown of the release layer 23*b* if the detected current was 500 μA or lower and that electrical breakdown had occurred if a current exceeding 500 μA was detected.

Table 1 shows the results of examination of the electrostatic offset and electrical breakdown tests of Neenah paper and Xerox paper according to the present embodiment and the comparative example. According to the configuration of the present embodiment, the current applied to the substrate 22*a* was interrupted by the insulating layer 22*b*, so that no occurrence of electrical breakdown was confirmed at the release layer 23*b* of the fixing film 23 even when a voltage as high as −1000 V was applied. Therefore, it was confirmed that electrostatic offset could be suppressed even by using a type of paper such as the Neenah paper that has a high resistance and is disadvantageous from the viewpoint of electrostatic offset. Meanwhile, based on the configuration of the comparative example, electrical breakdown of the release layer 23*b* had occurred at a point of time when a voltage of −750 V had been applied. According to the test, it was not possible to apply a voltage of −1000 V which is a voltage necessary to eliminate electrostatic offset of the Neenah paper, and so it was confirmed that the comparative example could only provide measures to cope with a recording material having a resistance equivalent to Xerox paper at most.

TABLE 1

| | | | APPLICATION VOLTAGE (V) | | | | |
|---|---|---|---|---|---|---|---|
| | | | −100 | −250 | −500 | −750 | −1000 |
| PRESENT EMBODIMENT | ELECTROSTATIC OFFSET | Neenah Bond | POOR | POOR | POOR | POOR | GOOD |
| | | Xerox Vitality | POOR | POOR | GOOD | GOOD | GOOD |
| | ELECTRICAL BREAKDOWN TEST | | GOOD | GOOD | GOOD | GOOD | GOOD |
| COMPARATIVE EXAMPLE | ELECTROSTATIC OFFSET | Neenah Bond | POOR | POOR | POOR | — | — |
| | | Xerox Vitality | POOR | POOR | GOOD | — | — |
| | ELECTRICAL BREAKDOWN TEST | | GOOD | GOOD | GOOD | POOR | POOR |

As described, according to the present embodiment, an electric field is formed in the fixing nip portion Nf by applying voltage to the substrate 22*a*, without supplying current between the fixing film 23 and the pressure roller 30. Thereby, the occurrence of electrostatic offset can be suppressed while preventing electrical breakdown of the release layer 23*b*, even if a high resistance paper such as Neenah paper was used.

According to the present embodiment, voltage was applied to the substrate 22*a* using an external power supply, but voltage can also be applied to the substrate 22*a* through a bypass from a charging bias, i.e., charging voltage, or a developing bias, i.e., developing voltage, having a same polarity as normal charging characteristics of toner. In that case, the high-voltage circuit board installed in the printer 100 and outputting these voltages constitutes the voltage application circuit, instead of the power supply DC1 according to the present embodiment.

Further according to the present embodiment, the resistance of the release layer 30*c* of the pressure roller 30 was set within the range of $1.0\times10^{8}$ [Ω/□] to $1.0\times10^{13}$ [Ω/□], but the present disclosure is not limited to the above-mentioned range. A configuration can be adopted where electric conductivity is applied to the elastic layer 30*b* of the pressure roller 30 itself to provide grounding through the core metal 30*a*.

If the pressure roller 30 is designed to have an insulating property, a similar effect as the present embodiment can be achieved by adopting a configuration where the sheet discharge roller 10 arranged downstream of the fixing unit 9 in the conveyance direction of the recording material has conductivity to provide grounding.

Second Embodiment

A configuration of grounding the substrate 22*a* of the heater 22 and applying voltage to the pressure roller 30 to suppress electrostatic offset is illustrated as a second embodiment. A configuration similar to the first embodiment is adopted except for the configuration related to grounding of the substrate 22*a* and voltage application to the pressure roller 30, so that similar elements are denoted with the same reference numbers as the first embodiment and descriptions thereof are omitted.

Figure 9:
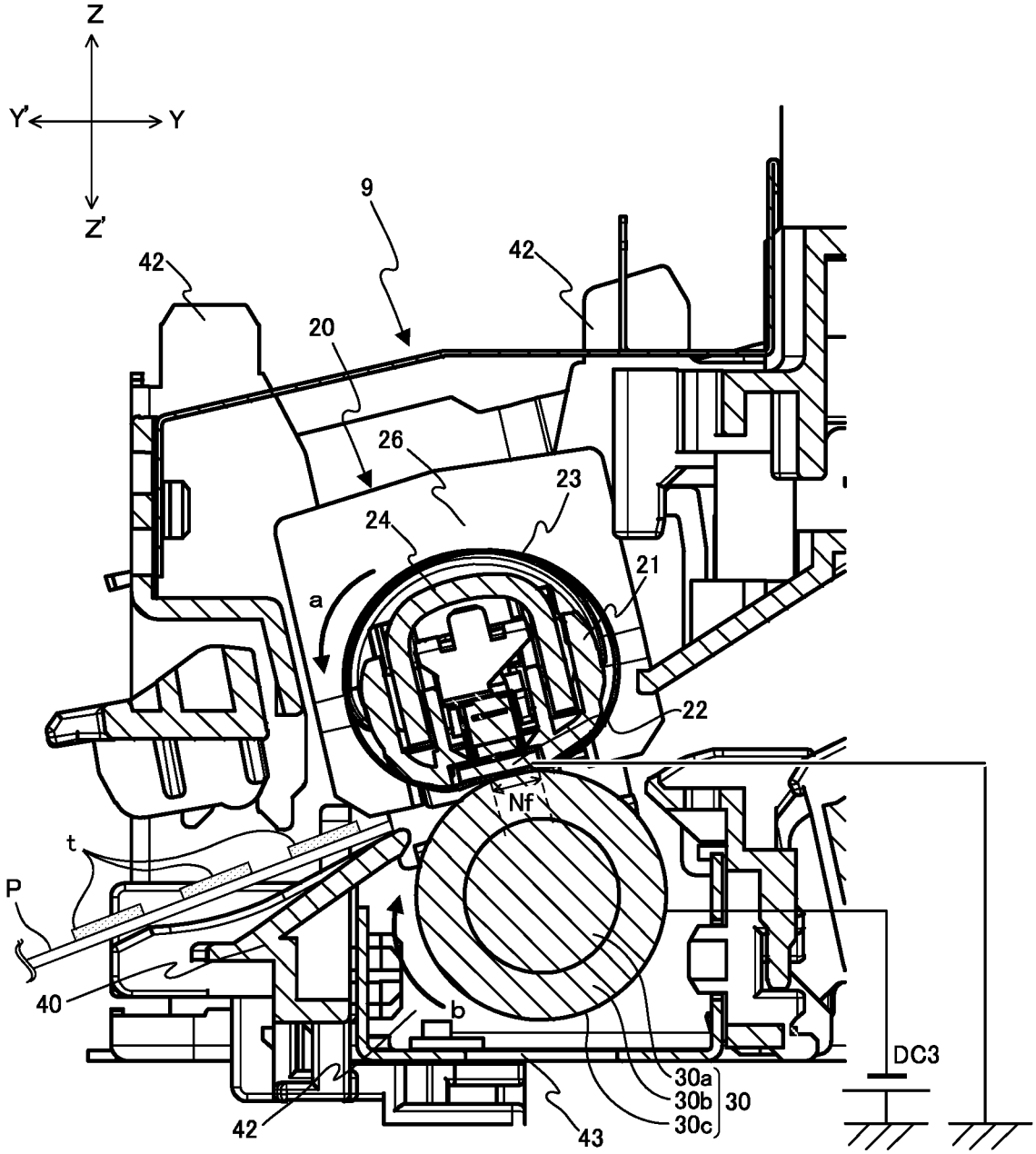
FIG. 9 is a cross-sectional view illustrating a fixing unit according to a second embodiment.

As illustrated in FIG. 9, the embodiment characterizes in that the release layer 30*c* of the pressure roller 30 is connected to a power supply DC3 and the substrate 22*a* is grounded. The power supply DC3 constitutes a voltage application circuit that applies voltage, i.e., applies potential, having an opposite polarity as the normal charging polarity of toner to the pressure roller 30. By applying voltage to the release layer 30*c* of the pressure roller 30 and grounding the substrate 22*a* as according to the present embodiment, it becomes possible to form an electric field in the fixing nip portion Nf without supplying current between the fixing film 23 and the pressure roller 30, similar to the first embodiment. Therefore, the occurrence of electrostatic offset can be suppressed while preventing electrical breakdown of the release layer 23*b*.

Table 2 shows the results of examination of the electrostatic offset and electrical breakdown tests of Neenah paper and Xerox paper according to the present embodiment. The outline of the tests is the same as the first embodiment, and descriptions thereof are omitted.

TABLE 2

| | | | APPLICATION VOLTAGE (V) | | | | |
|---|---|---|---|---|---|---|---|
| | | | −100 | −250 | −500 | −750 | −1000 |
| PRESENT EMBODIMENT | ELECTROSTATIC OFFSET | Neenah Bond | POOR | POOR | POOR | POOR | GOOD |
| | | Xerox Vitality | POOR | POOR | GOOD | GOOD | GOOD |
| | ELECTRICAL BREAKDOWN TEST | | GOOD | GOOD | GOOD | GOOD | GOOD |

According to the configuration of the present embodiment, if voltage is applied to the release layer 30*c* of the pressure roller 30, approximately no current is supplied to the substrate 22*a* owing to the presence of the insulating layer 22*b*, the occurrence of electrical breakdown of the release layer 23*b* was not confirmed even if a voltage as high as +1000 V was applied. Therefore, it was confirmed that electrostatic offset could be suppressed even by using a type of paper such as the Neenah paper that has a high resistance and is disadvantageous from the viewpoint of electrostatic offset.

According to the present embodiment, voltage was applied to the substrate 22*a* using an external power supply, but voltage can also be applied to the release layer 30*c* of the pressure roller 30 through a bypass from a transfer bias and the like having a different polarity as the charging characteristics of toner.

Further according to the present embodiment, the release layer 30*c* of the pressure roller 30 has conductivity, but a configuration can be adopted where the elastic layer 30*b* of the pressure roller 30 has conductivity and voltage is applied to the elastic layer 30*b* through the core metal 30*a*.

According further to the fixing unit of the respective embodiments described above, the heater 22 is directly in contact with the inner surface of the film, but it is also possible to arrange a sheet having a high thermal conductivity, such as a sheet formed of a material such as ferrous alloy or aluminum, between the heater and the inner surface of the film. In other words, a nip forming unit with a configuration where the heater heats the film through a sheet can be adopted.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026803, filed on Feb. 20, 2020, which is hereby incorporated by reference herein in its entirety.

What is claimed is:

1. A fixing unit comprising:

a film with a tubular shape;

a nip forming unit including a heater and configured to be in sliding contact with an inner surface of the film, the heater including a substrate made of metal, an insulating layer formed on the substrate, a heating element arranged on the insulating layer and configured to generate heat when electric current flows therethrough, and a power supply electrode electrically connected to the heating element;

a power supply connector electrically connected to the power supply electrode so that the power supply connector is connected to the heating element at a first end portion of the substrate in a longitudinal direction of the heater;

a pressing member opposed to the nip forming unit with the film interposed therebetween and configured to form a nip portion with the film, wherein a recording material is nipped and conveyed at the nip portion while an image formed by toner on the recording material is heated and fixed to the recording material; and a power supply configured to apply a voltage of a same polarity as a normal charging polarity of the toner to the substrate;

a clip attached to the substrate at a second end portion of the substrate opposite to the first end portion in the longitudinal direction; and a wire connecting the power supply and the clip such that the substrate is electrically connected to the power supply via the clip and the wire, wherein the first end portion of the substrate is projected outside of the film toward a first side in the longitudinal direction, and wherein the second end portion of the substrate is projected outside of the film toward a second side in the longitudinal direction.

2. The fixing unit according to claim 1, wherein the pressing member includes an outermost layer having conductivity, the outermost layer being electrically grounded.

3. The fixing unit according to claim 1, wherein the pressing member includes an elastic layer having conductivity and elasticity, the elastic layer being electrically grounded.

4. The fixing unit according to claim 1, wherein the nip forming unit includes a holding member configured to hold the heater, and wherein the clip is configured to fasten the heater to the holding member.

5. An image forming apparatus comprising:

an image bearing member configured to rotate;

a transfer unit configured to transfer a toner image borne on a surface of the image bearing member to a recording material; and the fixing unit according to claim 1 configured to fix the toner image transferred to the recording material by the transfer unit to the recording material.

6. The fixing unit according to claim 1, wherein the heater further includes a cover layer made of insulating material and formed on the insulating layer and the heating element, wherein the insulating layer covers part of a surface of the substrate while leaving the surface of the substrate exposed at the second end portion, and wherein the cover layer covers the insulating layer and the heating element while leaving the power supply electrode exposed at the first end portion.

7. The fixing unit according to claim 1, wherein the nip forming unit includes a heater holder that extends in the longitudinal direction and configured to hold the heater over an entire length of the heater in the longitudinal direction, and wherein the clip is configured to fasten the heater to the heater holder.

8. The fixing unit according to claim 1, wherein the heating element includes a first part and a second part each elongated in the longitudinal direction, wherein the power supply electrode of the heater is a first electrode, wherein the heater further includes (i) a second electrode provided on the first end portion of the substrate and (ii) a connecting portion electrically connecting the first part and the second part of the heating element on the second side in the longitudinal direction, wherein the first part of the heating element extends in the longitudinal direction between the first electrode and the connecting portion, and the second part of the heating element extends in the longitudinal direction between the connecting portion and the second electrode, wherein the second end portion of the substrate is arranged further on the second side in the longitudinal direction than the connecting portion.

9. The fixing unit according to claim 1, further comprising a first flange provided on the first side in the longitudinal direction and including a first regulating surface configured to regulate a movement of the film toward the first side in the longitudinal direction, a second flange provided on the second side in the longitudinal direction and including a second regulating surface configured to regulate a movement of the film toward the second side in the longitudinal direction, wherein the first end portion of the substrate is projected outside of the first regulating surface toward the first side in the longitudinal direction, and wherein the second end portion of the substrate is projected outside of the second regulating surface toward the second side in the longitudinal direction.

10. The fixing unit according to claim 1, further comprising a driving gear attached to an end portion of the pressing member in the longitudinal direction and configured to receive rotational driving force for driving the pressing member, wherein the second end portion of the substrate is arranged on an opposite side to the end portion of the pressing member in the longitudinal direction.

* * * * *